United States Patent [19]

Chang

[11] 4,002,961

[45] Jan. 11, 1977

[54] ELECTRONIC SWITCH FOR CONTROLLING THE SPEED OF A MOTOR

[76] Inventor: Ten-Hsiang Chang, P.O. Box 36-182, Taipei, China /Taiwan

[22] Filed: Sept. 5, 1975

[21] Appl. No.: 610,737

[52] U.S. Cl. ..... 318/305; 318/246; 200/157

[51] Int. Cl.[2] ..... H01H 13/08

[58] Field of Search ..... 200/257; 318/246, 249, 318/300, 349

[56] References Cited

UNITED STATES PATENTS

| | | | |
|---|---|---|---|
| 3,775,576 | 11/1973 | Brown | 200/157 |
| 3,936,708 | 2/1976 | Dummer | 318/249 |
| R26,781 | 2/1970 | Frenzel | 200/157 |

*Primary Examiner*—B. Dobeck
*Attorney, Agent, or Firm*—Morton J. Rosenberg

[57] ABSTRACT

An electronic switch for variably controlling the speed of an electric motor, comprising a stationary member, a trigger member, clip means for securing said trigger member slidably relative to said stationary member, a pair of electric cords extending from the inside of said trigger member for connecting said electronic switch in circuit with an electric motor and power source, switching means and a solid-state semiconductor control device supported within said trigger member; characterized in that, said switching means comprising two sets of contacts, with one set including three electrically conductive contacts, another set including one electrically conductive contact and a resistor for providing various resistance values, disposed on said trigger member in spaced relation to each other, and two electrically conductive bridging contacts mounted on said stationary member in isolated relation to each other for contacting with the respective set of contacts; while said trigger member being manually actuated with respect to said stationary member, the first bridging contact is movable among a non-bridging position wherein said first bridging contact engages with the first contact of the said three contacts, a first bridging position wherein said first bridging contact engages with the first and the second contacts of the said three contacts, and a second bridging position wherein said first bridging contact engages with the first and the third contacts of the said three contacts; simultaneously, the second bridging contact is movable with one end thereof slidably engaging with the contact of the associated set and the other end thereof slidably engaging with said resistor for providing various resistance values in a manner to control the application of variable magnitudes of electrical energy, for selectively varying the speed of said electric motor.

1 Claim, 6 Drawing Figures

ELECTRONIC SWITCH FOR CONTROLLING THE SPEED OF A MOTOR

BACKGROUND OF THE INVENTION

This invention relates in general to a switch for controlling the electric power supplied to a motor, for instance, an electric motor of a hand-operated power tool, and more particularly to a compact electronic switch comprising SCR or TRIAC and a trigger-type operating member for controlling the speed of a motor.

As can be seen, a conventional electrically operated switch would start a motor to its maximum speed immediately after being actuated, and cause severe vibration, especially, in the case of an electrically powered hand-type tools. If the objects handled with the motor are of high hardness, such as that in a lathe or drill mechanism, an accident may happen during operation even if the operator grasps it firmly. Furthermore, such severe vibration resulted from starting the motor rapidly to its maximum speed tends to force the objects leave their original position and to harm the outer surface of the objects. On the other hand, said vibration will cause the machine to be out of order early.

According to these problems, there are numerous switches have been provided in the prior art for causing the speed of a motor increase gradually from zero to a maximum or decrease gradually from a maximum to zero. However, such switches are generally of relatively high cost which limits their use in many applications.

It therefore is a particular object of the present invention to provide a highly compact electronic switch which can be expeditiously manufactured and assembled, and which results in a switch for smoothly and effectively controlling the speed of an electric motor by degrees from low to high or from high to low as required, and thus the vibration mentioned above can be avoided.

According to this invention, a novel electronic switch comprises a stationary member, a trigger member, clip means for securing said trigger member slidably relative to said stationary member, a pair of electric cords extending from the inside of said trigger member for connecting said electronic switch in circuit with an electric motor and power source, switching means and a solid-state secomiconductor control device supported within said trigger member; said switching means comprising two sets of contacts, with one set including three electrically conductive contacts, another set including one electrically conductive contacts and a resistor for providing various resistance values, disposed on said trigger member in spaced relation to each other, and two electrically conductive bridging contacts mounted on said stationary member in isolated relation to each other for contacting with the respective set of contacts; while said trigger member being manually actuated with respect to said stationary member, the first bridging contact is movable among a non-bridging position wherein said first bridging contact engages with the first contact of the said three contacts, a first bridging position wherein said first bridging contact engages with the first and the second contacts of the said three contacts, and a second bridging position wherein said first bridging contact engages with the first and the third contacts of the said three contacts; simultaneously, the second bridging contact is movable with one end thereof slidably engaging with the contact of the associated set and the other end thereof slidably engaging with said resistor for providing various resistance values to control the application of variable magnitude of electrical energy, for varying the speed of said electric motor.

Another object of this invention is to provide an arrangement of the foregoing and other essential members which is highly compact, is economically constructed, is conveniently assemblable, and is capable of being mass produced.

Other objects and advantages of this invention will be more readily apparent from the following description of two preferred embodiments thereof with reference to the accompanying drawings wherein.

The first embodiment of the present invention is a half wave speed trigger switch comprising silicon control rectifier (SCR), and the second embodiment thereof is a full wave speed trigger switch comprising triode AC semiconductor (TRIAC).

Figure 1:
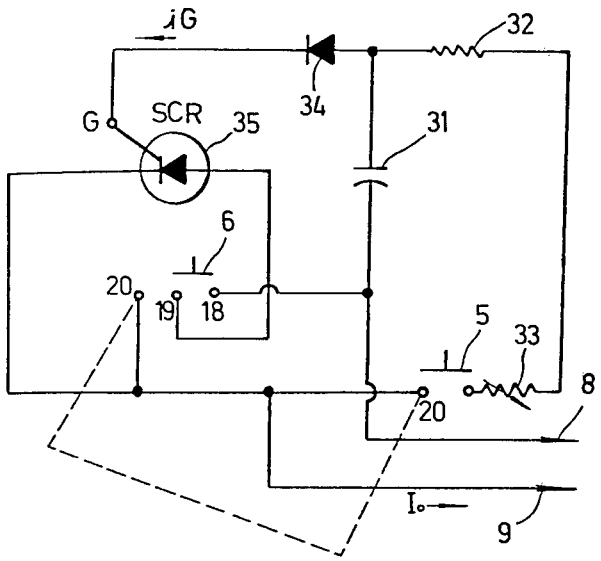
FIG. 1 is a circuit diagram showing the circuit comprised in an electronic switch according to the first embodiment of the present invention.

Now referring to FIG. 1, there is shown a circuit comprised in the first embodiment of this invention. It can be understood that, the capacitor 31 cooperates with the resistors 32 and 33 to form a phase control circuit; the triggering signal $i_G$ is applied from the connection between the capacitor 31 and the resistor 32, through diode D to the gate G of SCR 35, as shown. The phase of said triggering signal $i_G$ is controlled by varying the resistance value of the resistor 33, and thus control the magnitude of the current Io flowing through the anode and cathode of SCR 35. The variation of the resistance value of the resistor 33 is effected by a trigger-type mechanism including two sets of contacts, with one set comprising contacts 18, 19 and 20, and another set comprising the contact 20 and the resistor 33, disposed on a trigger member, and two bridging contacts 5 and 6 mounted on a stationary member, which are schematically shown in FIG. 1, and will be described with respect to their arrangement hereinafter.

While such trigger-type mechanism is manually actuated by depressing said trigger member against said stationary member, the first bridging contact 6 moves from a non-bridging position wherein the bridging contact 6 engages with said contact 18 and breaks the circuit, to a first bridging position wherein the bridging contact 6 engages with said contacts 18 and 19 to encircuit the electronic elements, at the same time, the second bridging contact 5 engages with the contact 20 and the resistor 33 and slidably moves along said resistor 33 to vary the resistance value provided for the phase control circuit, whereby control the phase of the triggering signal $i_G$ and therefore control the magnitude of current Io, and as the first bridging contact 6 moves to a second bridging position wherein the bridging contact 6 engages with the contacts 18 and 20, then a full-line voltage is applied to the motor.

Figure 6:
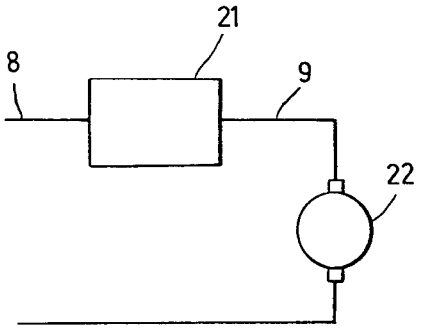

An arrangement 21 comprising such circuit element may be connected in the motor circuit, as shown in FIG. 6, to control the magnitude of power supplied by a source and thus control the speed of motor 22.

Figure 2:
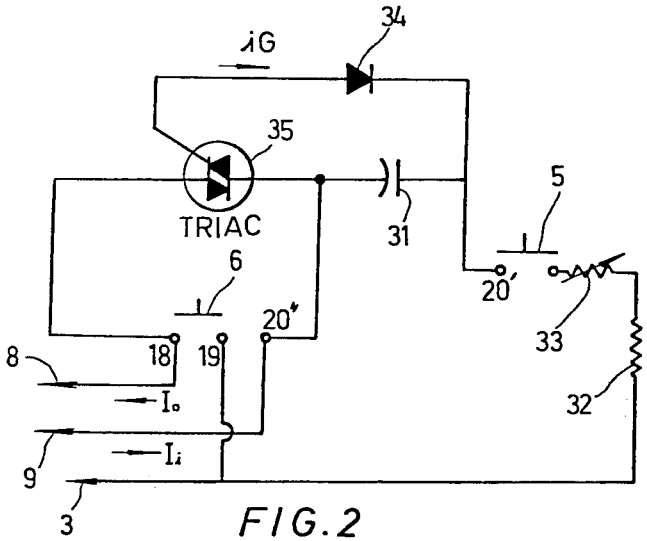
FIG. 2 is a circuit diagram showing the circuit comprised in an electronic switch according to the second embodiment of the present invention.

Now referring to FIG. 2, the circuit comprised in the second embodiment of the invention is shown. Similarly, the capacitor 31 cooperates with the resistors 32 and 33 to form a phase control circuit; and the combination of this circuit is similar to that shown in FIG. 1 except that the first set of contacts including contacts 18, 19 and 20'' and the second set of contacts including contact 20' and resistor 33 with contacts 20' and 20'' being isolated, and the magnitude of Io is controlled by TRIAC full wave control device instead of by the SCR half wave control device. An arrangement 21 comprising such circuit may be connected in the motor circuit, as shown in FIG. 6, to control the speed of motor 22.

Figures 3, 4:
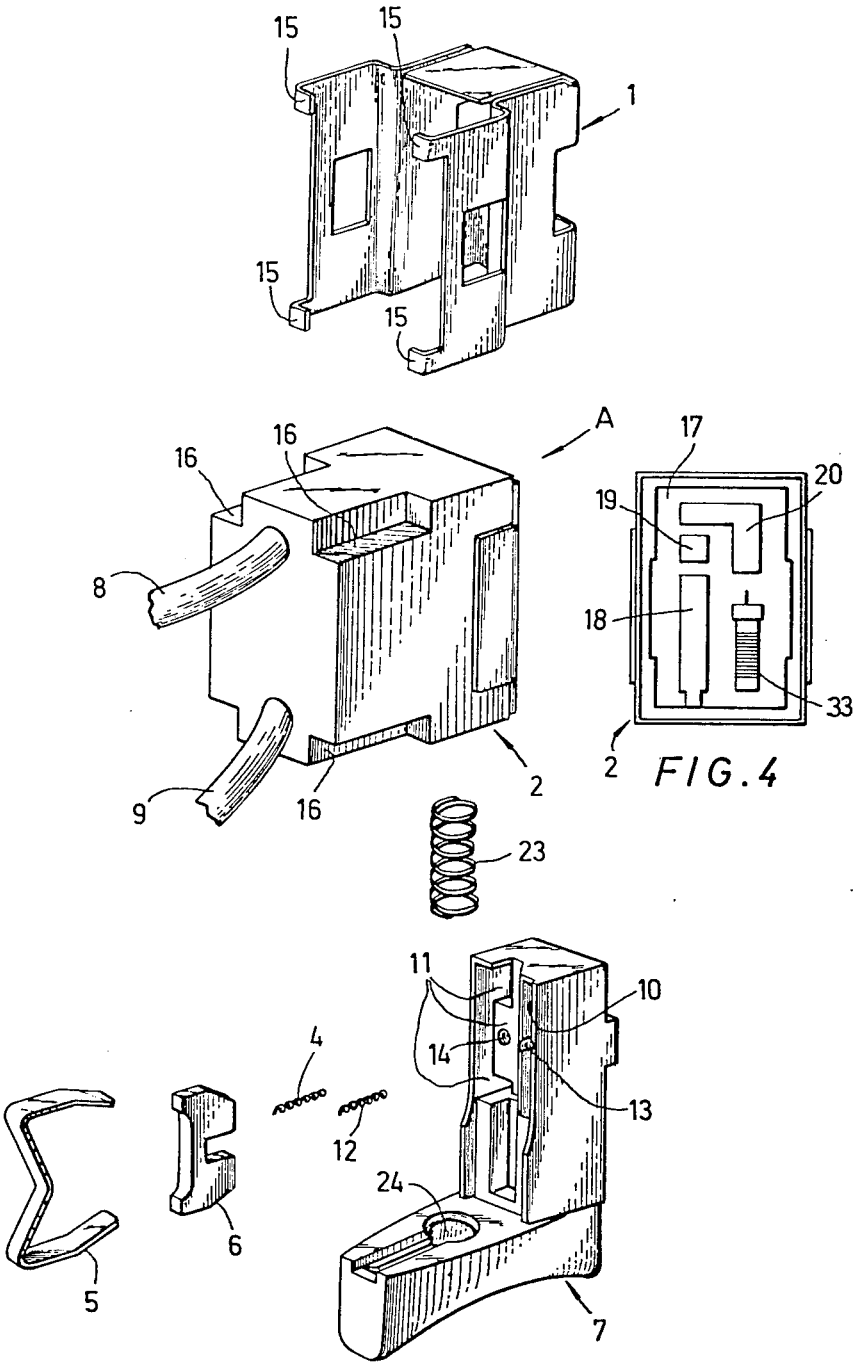
FIG. 3 is an exploded perspective view of an electronic switch according to the embodiment of the present invention.
FIGS. 4 and 5 are plan views of the trigger member of respective embodiment from the direction of arrow A shown in FIG. 3, illustrating the particular arrangement of contacts disposed on said trigger member.

Now turning to the arrangement of the electronic switch of this invention, the first embodiment of this invention is shown in FIG. 3, comprising a clip member 1, a trigger member 2 and a stationary member 7 being secured together by means of said clip member 1, a compression spring 23, and electronic control circuit element mounted in said trigger member 2. The trigger member 2 carries the electrical elements of the control circuit shown in FIG. 1, some of said electrical elements are exposed in FIG. 4, wherein the electrically conductive contacts 18, 19 and 20 of particular configuration and the resistor 33 are disposed on an insulating plate 17 in spaced relation to each other. The recess portions 16 of said trigger member 2 are provided for engaging with the flanges 15 of said clip member 1 in assembling. Numerals 8 and 9 represent the lead-out electric cords 8 and 9 illustrated in FIG. 1. It can be seen from FIG. 3, the stationary member 7 is provided with two grooves 10 and 11 separated with a barrier, two circular wells 13 and 14 in said grooves 10 and 11 for accommodating springs 12 and 4 respectively, and a larger well 24 for accommodating one end of said compression spring 23. During assembling, the bridging contact 6 is fitted in said groove 10, and is biased by the spring 12 in said well 13 to slidably engage with the contact 18 in a non-bridging position, while the second bridging contact 5 is fitted in said groove 11, and is biased by the spring 4 in said well 14 to slidably engage with the contact 20 and the resistor 33. One end of said compression spring 23 is mounted in said well 24 of the stationary member 7, and the other end thereof is mounted in another well on the surface of the trigger member 2 adjacent and opposite to said well 9, so that the trigger member 2 is biased against the stationary member 7.

In operation, the trigger member 2 is manually compressed by gripping to move with respect to the stationary member 7, such that the bridging contacts 6 and 5 slide over the insulating plate 7, wherein the first bridging contact 6 moves into the first bridging position and then into the second bridging position as described hereinbefore, and the second bridging contact 5 moves with one end thereof slidably engaging the contact 20 and with the other end thereof slidably engaging the resistor 33 to vary the resistance value which is given to the phase control circuit.

Figure 5:
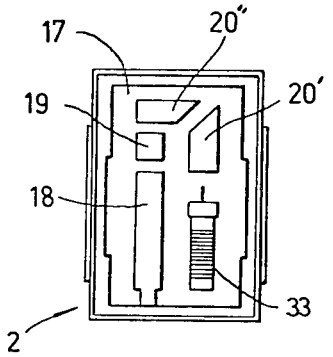

The structure of the second embodiment comprising the circuit shown in FIG. 2 is substantially equal to that illustrated in FIG. 3, except that the contacts 20' and 20'' are isolated, as shown in FIG. 5.

Numerous alternations of the structure herein disclosed will suggest themselves to those skilled in the art. However, it is to be understood that the present disclosure relates to preferred embodiments which is for purpose of illustration only and is not to be construed as a limitation of the invention.

What is claimed is:

1. An electronic switch for variably controlling the speed of an electric motor, comprising a stationary member, a trigger member, clip means for securing said trigger member slidably relative to said stationary member, a pair of electric cords extending from the inside of said trigger member for connecting said electronic switch in circuit with an electric motor and power source, switching means and a solid-state semiconductor control device supported within said trigger member; characterized in that, said switching means comprising two sets of contacts, with one set including three electrically conductive contacts, another set including one electrically conductive contact and a resistor for providing various resistance values, disposed on said trigger member in spaced relation to each other, and two electrically conductive bridging contacts mounted on said stationary member in isolated relation to each other for contacting with respective set of contacts; while said trigger being manually actuated with respect to said stationary member, the first bridging contact is movable among a non-bridging position wherein said first bridging contact engages with the first contact of the said three contacts, a first bridging position where said first bridging contact engages with the first and the second contacts of the said three contacts, and a second bridging position wherein said first bridging contact engages with the first and the third contacts of the said three contacts; simultaneously, the second bridging contact is movable with one end thereof slidably engaging with the contact of associated set and the other end thereof slidably engaging with said resistor for providing various resistance values in a manner to control the application of variable magnitude of electrical energy, for selectively varying the speed of said electric motor.

* * * * *